United States Patent [19]

Schenk

[11] 4,416,185

[45] Nov. 22, 1983

[54] ALTERNATE AMMUNITION BELT FEEDER OF AN AUTOMATIC FIRE ARM HAVING A LINEAR BREECH

[75] Inventor: Norbert Schenk, Düsseldorf, Fed. Rep. of Germany

[73] Assignee: Rheinmetall GmbH, Düsseldorf, Fed. Rep. of Germany

[21] Appl. No.: 276,828

[22] Filed: Jun. 24, 1981

[30] Foreign Application Priority Data

Jun. 26, 1980 [DE] Fed. Rep. of Germany ..... 3023957

[51] Int. Cl.[3] ..... F41D 10/32

[52] U.S. Cl. ..... 89/33 SF

[58] Field of Search ..... 89/33 SF

[56] References Cited

U.S. PATENT DOCUMENTS 3,452,640 7/1969 Maillard ..... 89/33 SF
4,273,025 6/1981 Bremer et al. ..... 89/33 CA

FOREIGN PATENT DOCUMENTS 2303953 8/1974 Fed. Rep. of Germany .
2825091 1/1980 Fed. Rep. of Germany .

*Primary Examiner*—Stephen C. Bentley

[57] ABSTRACT

An alternate ammunition belt feeder for selectively feeding one of two types of ammunition from two separate ammunition belts via two separate cartridge feeding stars into the linear breech pocket of an automatic fire arm, such as a machine cannon. Two cartridge feeders, which include the two cartridge feeding stars are adapted to coact with one piston-cylinder arrangement forming an energy converter which converts a portion of the pressurized gas which forms during firing into mechanical energy for driving the piston cylinder arrangement. The cartridge feeders are operatively mounted in a housing which is pivotally mounted in the weapon so that it can be swung from a first operative position via an intermediate inoperative position to a second operative position. Thereby the housing can be selectively positioned between the first and second operative positions and cartridges from a preselected feeders can be fired from the weapon by being positioned for entrainment by the breech block of the weapon. The cartridge feeding stars are mirror-symmetrically mounted in the housing which includes a bisecting U-shaped foot portion. When the housing is in the intermediate position no actuation of the piston cylinder arrangement is possible and the breech block of the weapon is free to reciprocate without engaging the U-shaped foot portion of the housing.

9 Claims, 8 Drawing Figures

ALTERNATE AMMUNITION BELT FEEDER OF AN AUTOMATIC FIRE ARM HAVING A LINEAR BREECH

BACKGROUND OF THE INVENTION

An arrangement for alternately feeding ammunition from two ammunition belts to an automatic fire arm is already known as per German published unexamined patent application No. 2,825,091 (continuation in part of German Pat. No. 2,303,953 which corresponds to U.S. Pat. No. 3,875,845). Such known arrangement provides for an alternate rapid switching over from one to the other feed mechanism, whereby after the switching over there is immediately ready for firing a cartridge from the corresponding feeder. The energy converter in this known arrangement consists of a gas piston having a gear rack, which piston is arranged transversely to the longitudinal axis of the weapon, and which gear rack meshingly engages in a right pinion wheel which in turn meshes with a left pinion wheel of the ammunition feed arrangement. In order to receive a respective return positioning spring, the pinion wheels are formed as cylindrical bushings having gear wheels mounted thereon, and these bushings are disposed with their rotational axes at both sides of the vertical plane which coincides with the bore axis of the gun barrel. The pinion wheels each mesh with a respective star wheel shaft which confronts the open mouth of each pinion wheel. The star wheel shafts are actuated by means of lateral slidable displacement towards the left (right) so that the end of the right (left) star wheel shaft of the corresponding feeder is meshingly form-lockingly engaged for actuating the respective feeder. The inlet openings lie in the immediate vicinity of a vertical bisecting plane at each side thereof, which is disposed between the star wheel shafts and which shafts are driven in opposite directions.

This known arrangement is complex, it requires a separate switching drive, which increases the number of individual parts of the total arrangement. Its disassembly, for example, when replacing parts is quite difficult and cumbersome.

SUMMARY OF THE INVENTION

It is the general object of this invention to provide an arrangement of the aforedescribed type whereby by means of a simple construction, which is relatively inexpensive to manufacture and which can be easily serviced, can be switched over from one ammunition feed to the other with reduced energy input and which is very compactly constructed.

By having each feeder include a respective integrated energy input, which accepts energy when form-locked to the energy output, it is possible, in the event one of the belt feeders is put out of action, to continue firing with the other belt feeder. In addition thereto possibility of a faulty meshing of form locking means due to faulty servicing and the thereby accompanying malfunctions are eliminated. By positioning the arrangement in the neutral middle position it is possible in a simple manner to obtain a secure and reliable functioning of the device.

By arranging the belt inlets in the immediate vicinity of the swing axis there can be advantageously effected an ammunition change substantially independently from the belt pulling force.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
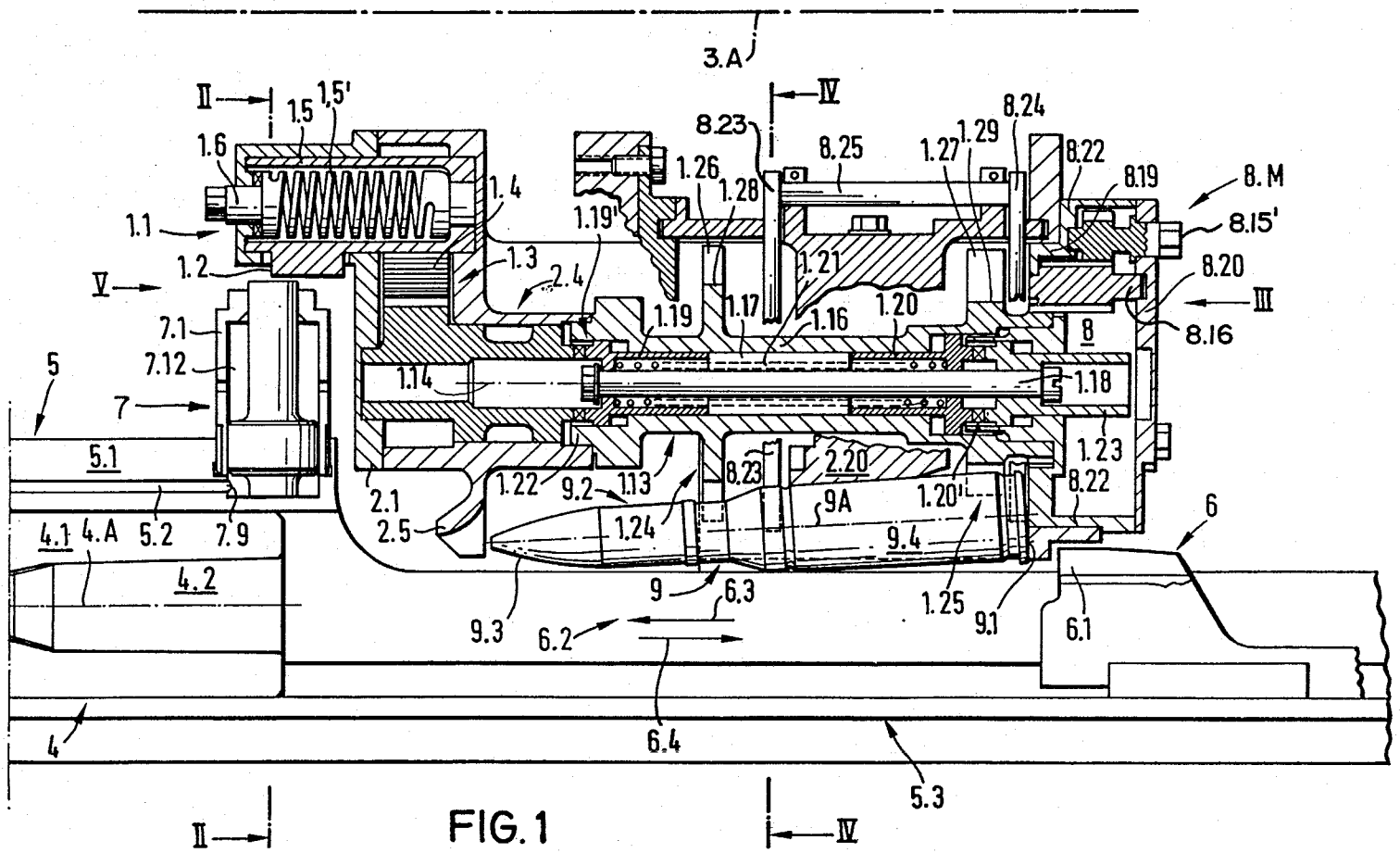
FIG. 1 illustrates the alternate feeder in accordance with the invention with portions thereof illustrated in longitudinal section for purposes of clarity, some of which sections are displaced for purposes of clarity.

In the following description, for the sake of clarity the arrangement is divided into the following groups:

Feeder 1; feeder housing 2; cradle-fixed support (not shown) carriage for the feeder housing 2; such carriage pivoting about axis 3A; gun barrel 4; weapon housing 5; breech block 6; energy converters 7; control and switching arrangement 8; and projectile with cartridge 9.

In the aforedescribed groups of parts the individual parts are numbered with the number of the group followed by a period and consecutive numbers for a better understanding of the invention. In view of the essentially mirror-symmetrical arrangement of the left and right feeder there is added to the reference number either the letter l (for "left") and the letter r (for "right").

The gun barrel 4 has a gun barrel axis 4A and a gun barrel wall 4.1 which defines a loading chamber 4.2 (FIG. 1). The gun barrel 4 is in the illustrated region of FIG. 1 surrounded by the weapon housing 5 which has a wall 5.1 and a gas channel 5.2. The weapon housing 5 has at its underside a cartridge expelling opening 5.3 on top of which, along the prolonged gun barrel axis 4A, a path of movement 6.2 for the breech block 6 with the entrainer 6.1 is illustrated by means of arrows 6.3 and 6.4. Arrow 6.3 indicates the direction of counter recoil movement of the breech block 6 in the gun barrel 4 and arrow 6.4 indicates the recoil direction of breech block 6 which impacts on a non-illustrated buffer. In the rear region of the gun barrel 4 there is on the top thereof arranged the energy converter 7. The converter is constructed as a cylinder-piston arrangement which comprises a cylinder 7.1 having a flying piston 7.2 mounted therein. The latter extends along a longitudinal piston axis 7A (see FIG. 2) and has a downwardly directed energy receiving side 7.3 and an upwardly directed energy transferring side 7.4, whereby a stop 7.5 extends from the former and the piston rod 7.6 extends from the latter, both of which extensions have circular cylindrical cross-sections. The piston rod 7.6 terminates at its upper free end with an end face 7.7 and extends through a guide opening 7.8 in the upper end wall of the cylinder 7.1 which end wall thereby defines a cylindrical inner chamber 7.12. In its lower region of the cylinder 7.1 has an outlet opening 7.9 which is in communication with the gas channel 5.2 (FIG. 1). Thus the inner chamber 7.12 is in communication with the gas channel 5.2 by means of a gas spring, formed as a gas storage means, which is described in the German published unexamined patent application No. P2,809,505.8-15 which corresponds to U.S. Pat. No. 4,273,025. A prolongation of the vertically oriented longitudinal piston axis 7A intersects the gun barrel axis 4A at 90°. For purposes of clarity there is partially omitted the illustration of the feed housing 2 and completely omitted the illustration of the fixed-cradle support carriage (not shown) for the feed housing 2. For a sufficient overview and understanding there is, however, illustrated in FIGS. 2 to 5 the point of intersection 3A of the fixed-cradle swing axis with the plane of the drawing.

The connections between the various subunits will become clear from the following description.

Figure 4:
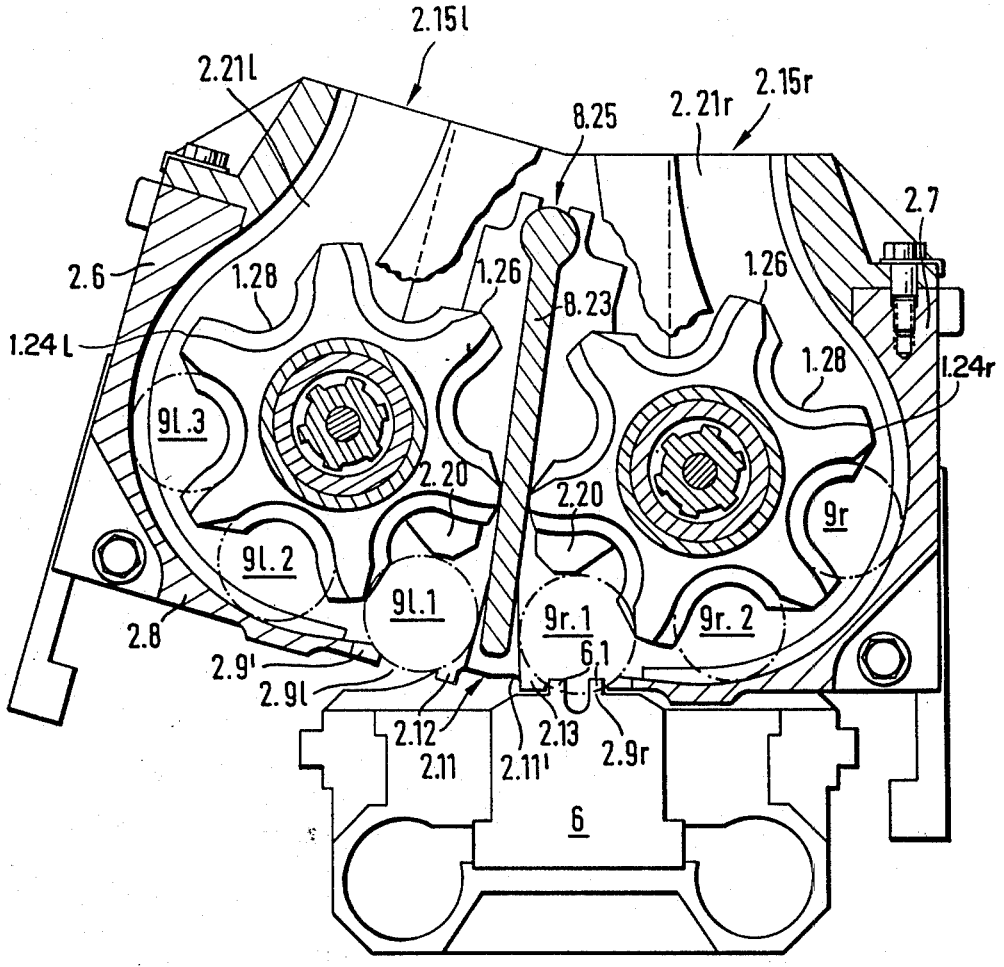
FIG. 4 is a transverse axial sectional view along line IV—IV in FIG. 1.

The feed housing 2 extends axially from a front wall 2.1 to a rear wall 2.2 (see FIG. 1). The side wall 2.6 and 2.7 are prolonged by an underside wall 2.8 which defines a middle opening (FIG. 4). The underside opening is divided by means of an interior wall 2.5 having a foot portion 2.11 which extends longitudinally axially through the feed housing 2 and divides into two halves. The foot portion 2.11 has a left stop ledge 2.12 and a right stop ledge 2.13 which are disposed at a predetermined distance laterally from the longitudinal axis adjacent to a corresponding end region 2.9$^1$ of the underside wall 2.8, whereby there results in view of the spatial relationship of the end regions 2.9$^1$ a corresponding left expelling slit 2.9l and an expelling right slit 2.9r. The foot portion 2.11 has at its underside two stop ledges 2.12 and 2.13 and a longitudinally axially extending U-profile portion 2.11$^1$. The feed housing 2 serves to receive two mirror-symmetrically arranged star-feed wheel 1.l and 1.r. In the forward region of the feeder housing 2 there is arranged on its upper side a support structure for each feeder 1 and energy receiver 1.1, which structure is generally designated with the reference 2.4.

Figure 3A:
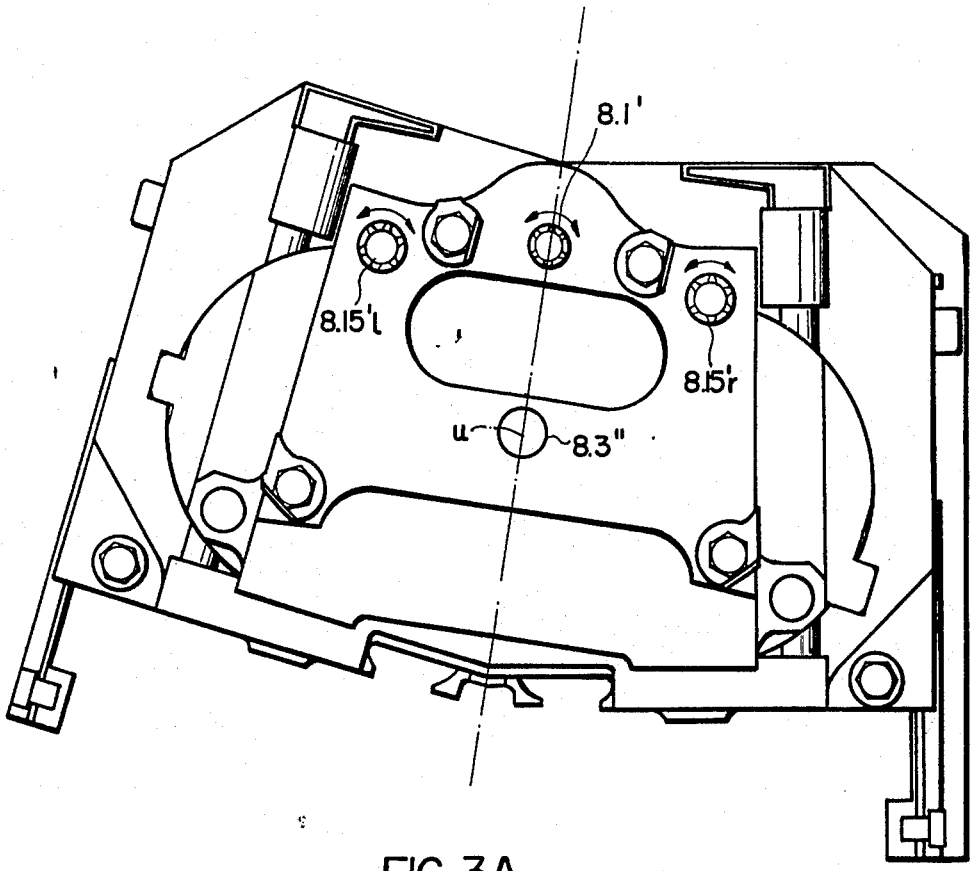
FIG. 3A is a side elevational view of the basic part of the apparatus shown in FIG. 3B.
Figure 3B:
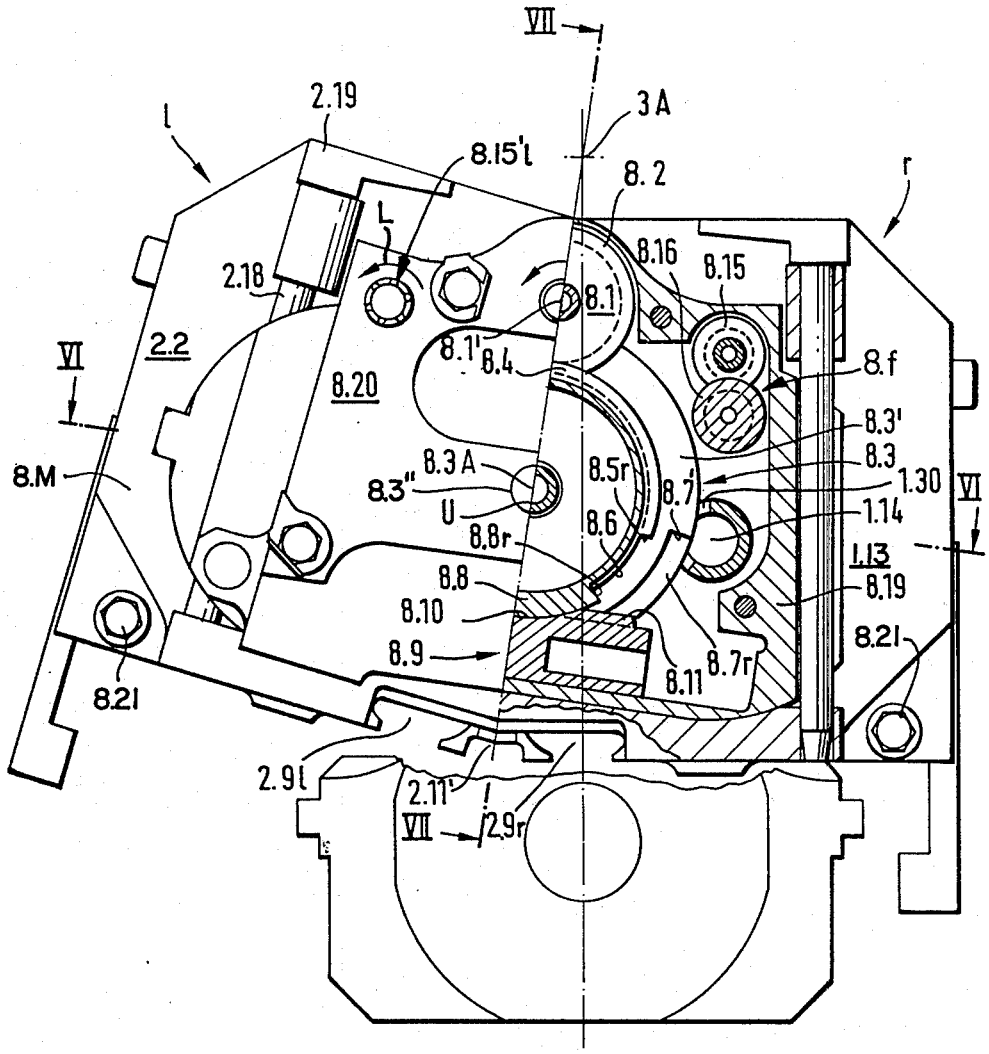
FIG. 3B is a side elevational view in the direction of arrow III in FIG. 1 shown partially in section.
Figure 6:
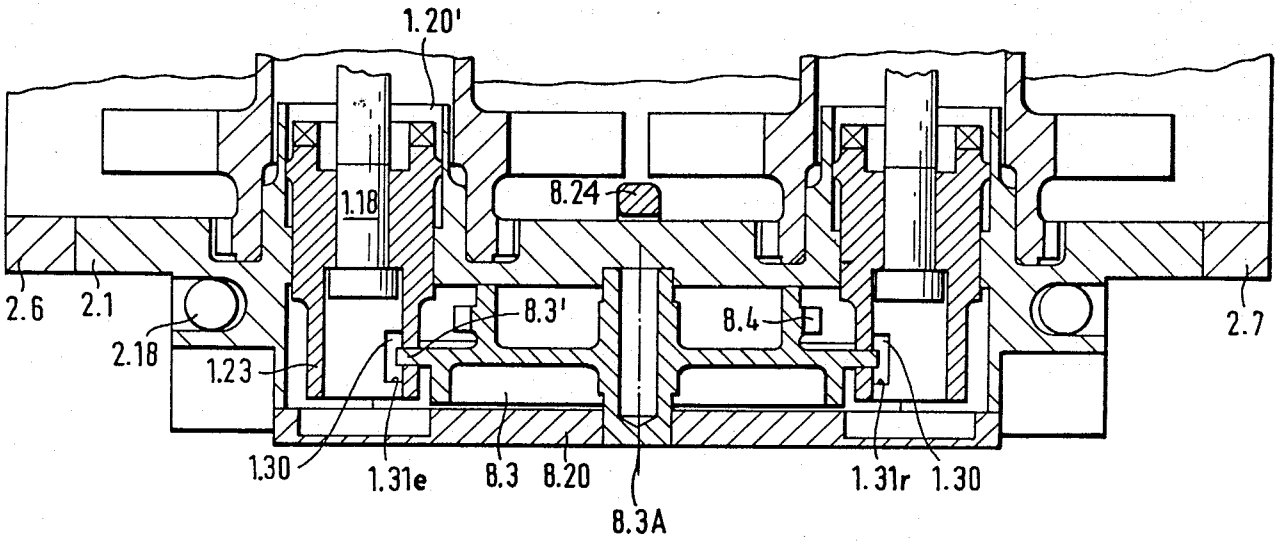
FIG. 6 is a partial cross-sectional view taken along line VI—VI in FIG. 3 through and parallel to the longitudinal axis of the arrangement.
Figure 7:
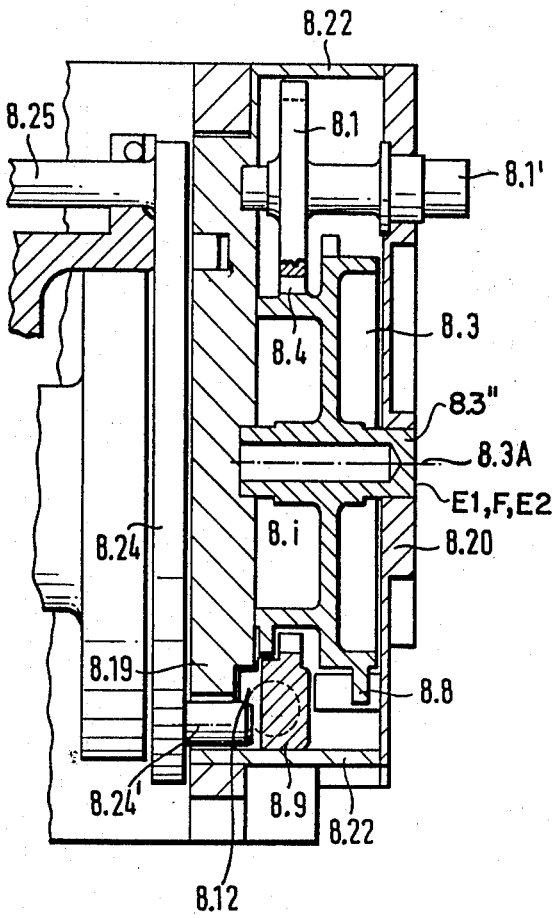
FIG. 7 is a partial cross-sectional view through and parallel to the longitudinal axis along lines VII—VII in FIG. 3.

The latter supports an arrangement which has a cylindrical jacket 1.5 in which an inlet 1.2 member facing towards the middle of the assembly and an outlet member 1.3 and a torsion spring 1.5$^1$ is arranged, which jacket 1.5 is rotatable about axis 1.6. The inlet member 1.2 and outlet member 1.3 are with mutually confronting sides rigidly connected with the jacket 1.5. Thereby the inlet member 1.2 is constructed as a lever element having a free end 1.2 and the outlet member 1.3 is constructed as a roller-segment-shaped element having a toothed segment 1.4. The toothed segment 1.4 meshes with a toothed segment 1.11 of an intermediate wheel 1.9 which is rotatably mounted in the feed housing 2 about an axis 1.10; the toothed segment 1.11 in turn meshes with a toothed segment 1.15, which is firmly connected to a star wheel shaft 1.13. The latter extends axially, longitudinally along an axis 1.14 and encompasses a hollow inner support shaft structure 1.17 which extends through a jacket 1.16 having a frong star wheel 1.24 (with teeth 1.26) and a rear star wheel 1.25 (with teeth 1.27). The support shaft structure 1.17 encompasses a sleeve support member 1.19 extending through the front end thereof and having a transport-coupling 1.19$^1$ and a sleeve support member 1.20 which extends through the rear end thereof into the interior of the jacket 1.16 and has a hold-coupling 1.20'. An outer sleeve support member 1.23 adjoins the inner support member 1.20 via coupling member 1.20' and extends towards the rear. The aforementioned sleeve support members are axially slidably connected to each other by means of a long screw bolt having a screw head not illustrated in detail and a threaded end with a nut mounted thereon, whereby between the sleeve support members 1.19 and 1.20 there is disposed a coil spring 1.21 which maintains the two support members 1.19 and 1.20 at a predetermined axial distance from each other. The star wheel shaft arrangement 1.13 is at its forward end rotatably supported in the support structure 2.4 and at its rear end in a support structure 8.19. Between the latter and an adjacent but axially spaced end face wall 8.20 there is defined and enclosed an inner space 8.i. In this inner space 8.i there are arranged the following control and switching means which form part of the switching arrangement 8, and which are manually actuated by non-illustrated means: a simple switching pinion 8.1, a switching roller 8.3, an extended control support member 8.9 having a recess 8.12 as well as auxiliary and intermediate pinions 8.15 and 8.16 which are generally designated with the reference number 8.f and which effect hereinafter to be described auxiliary functions. In a region between the feeders 1.l and 1.r there is arranged a further auxiliary arrangement. It has a longitudinal axially extending shaft 8.25 supported on opposite sides of the feed housing 2, on the forward end of which a swing lever 8.23 and on the rear end of which a swing lever 8.24 is mounted. Both swing levers 8.23 and 8.24 extend with their free ends downwardly and are, as will be described hereinafter in more detail, actuatable by means of the control and switching means 8.h. To the left and right of the auxiliary arrangement 8.t there is arranged for each feeder 1.l and 1.r respectively a spring-biased hold-down member 2.20l and 2.20r. These hold-down members are form lockingly but releasably mounted in the feeder housing 2. On its upper side of the feeder housing 2 has, in the immediate vicinity of the swing axis 3A, a corresponding belt inlet 2.15 (l and r). These ammunition belt inlets are in communication with corresponding guide channels 2.21 (l and r), in whose region known and non-illustrated debelting elements are arranged. As illustrated in FIG. 3, each support member 1.23 is provided at its rear with a corresponding cut-out portion 1.30 which confronts the middle region. In this cut-out portion there engages the switching roller 8.3 which has a disc-shaped border region 8.3', on which there are arranged respective coupling pullers 8.7l and 8.7r. The latter are embodied as edge-strips, which follow a helical line of predetermined pitch between a starting point 8.7' and a non illustrated end, which helix is disposed about an axis 8.3A. This helical edge strip 8.7 (r and l) coacts with a respective control stop 1.31l, 1.31r. For the left feeder 1.l the helical line is towards the right and for the right feeder 1.r the helical line is toward the left. On a not further illustrated backside, which can be seen in FIG. 3, the switching roller 8.3 has in its upper region a concentric circular segment toothed element 8.4, which extends in the shape of a circular arc between a right-hand ledge 8.8r and a corresponding, non-illustrated left end ledge. Between the end ledges 8.8r (l), and 8.5r (l) there extends along the same angle a corresponding non-toothed segment-region 8.6. A centering segment 8.8 is axially displaced rearwardly with respect to the toothed circular segment 8.4 and corresponds with a mating fixing recess 8.10 of the control support member 8.9. In the plane of the toothed circular segment 8.4, the control support member 8.9 is provided at its upper side with a linear toothed rack 8.11 which is adapted to mesh with the toothed circular segment 8.4 in a manner to be described hereinbelow. The control support member 8.9 has at its front side, which is not illustrated in detail but is illustrated schematically in FIG. 6, a recess 8.12, for receiving a deflecting bolt 8.24' extending from the side of the confronting rear swing lever 8.24. Concentrically with the axis 8.3A the switching roller 8.3 is mounted at the rear outer end face wall 8.20 in the region of a not further illustrated bore. The markings E1, E, E2 are affixed. A not further illustrated shaft end of the switching roller 8.3 is provided with a peripheral mark U. The relationship between the latter mark and the markings E1, F and E2 will be described hereinafter.

The central switching pinion 8.1 has an end 8.1 extending rearwardly out of the end wall 8.20 which may be in the form of an hexagonal head and which may be manually actuated (rotated) by a non-illustrated tool. Similarly a shaft 8.15' (l, r) which forms an extension of the auxiliary pinion 8.15 (l, r) extends past the end face 8.20 in the form of a not further illustrated hexagonal head for a corresponding manual actuation. Via an intermediate pinion 8.16 (l, r) there is provided a form locking in a not further described and illustrated manner, between the respective auxiliary pinion 8.15 and the respective cylindrical jacket 1.16 of the corresponding star wheel shaft arrangement 1.13. The rear outer end face wall 8.20 is releasably mounted by means of screws or bolts 8.21 on the inner end wall structure 8.19, that is on an axial wall portion 8.22 in the upper and lower region thereof. In the inner space 8.i there is arranged a control and switching mechanism 8.h and the auxiliary and intermediate pinions 8.15 and 8.16 which are designated with the reference numbers 8.f which forms a further disassemblable mounting unit 8.M, which is releasably and detachably mounted on the feeder housing 2 by means of manual actuating member 2.19 and pins 2.18, as is illustrated in FIG. 3, whereby a simple detachable connection with the feeder housing 2 is provided. As can be recognized from FIGS. 1 and 3, after pulling out the holding pins or pegs 2.18 there can also be pulled out rearwardly with the mounting unit 8.M also the two star wheel shaft arrangements 1.13 (l, r) from the feeder housing. Thereby a partial disassembly for servicing is achieved without any use of tools. This is a particularly advantageous feature in view of the extraordinary prevailing conditions which may exist during the operation of the alternate ammunition feeder.

Figure 5:
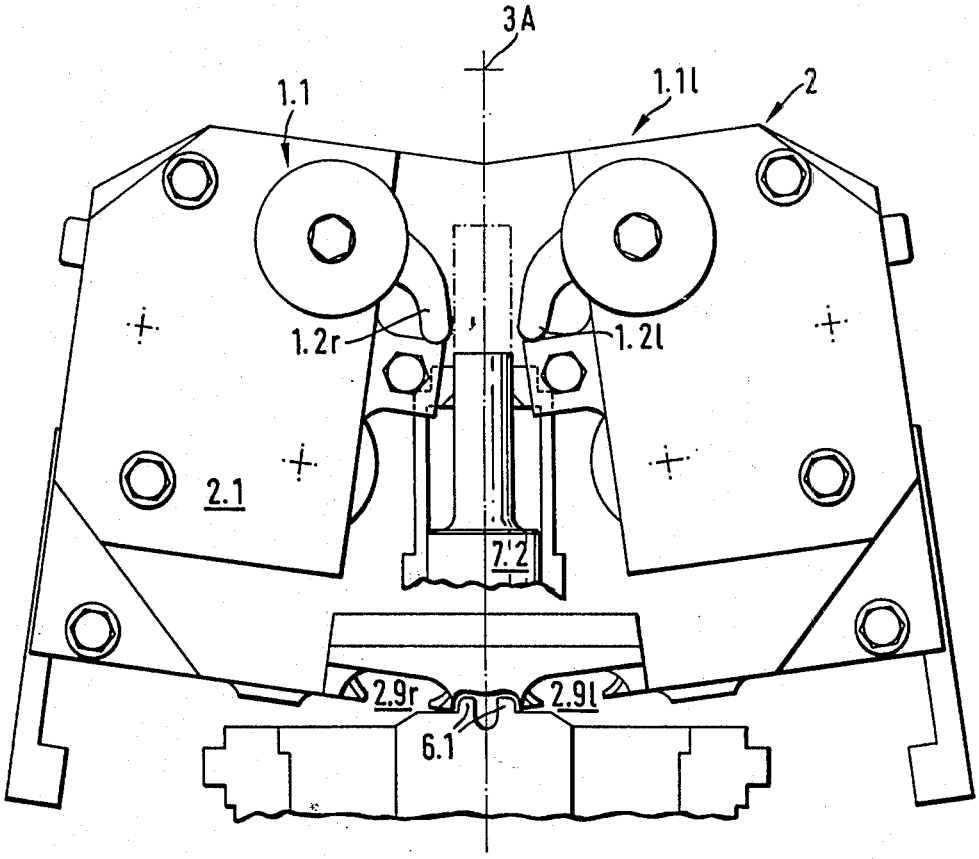
FIG. 5 is a side elevational view in the direction of the arrow V in FIG. 1 at an enlarged scale.

By swinging the feeder housing 2 about the cradle-fixed swing axis 3.A in one of the two end positions either the right (see FIG. 2) of left (FIG. 3), input 1.2 of the energy absorber 1.1 can be brought with its free end region 1.2' into the immediate vicinity on top of the end face 7.7 of the operative side 7.4 of the piston 7.2. Simultaneously therewith the appurtenant expelling slit 2.9 (see FIG. 4) is brought along the path of movement 6.2 of the breech 6 into the active region of the entrainer 6.1. In a neutral middle position, as shown in FIG. 5 the U-profiled member 2.11' furnishes a free movability for the breech 6 that is the entrainer 6.1 does not entrain a cartridge from either feeder; moreover, there cannot occur between the end faces 7.7 of the piston rods 7.6 a form locking with either of both energy inlet members 1.2 (l, r). Also both expelling slits 2.9 with the therein disclosed cartridge is removed from the active region of the entrainer 6.1.

MANNER OF OPERATION

Figure 2:
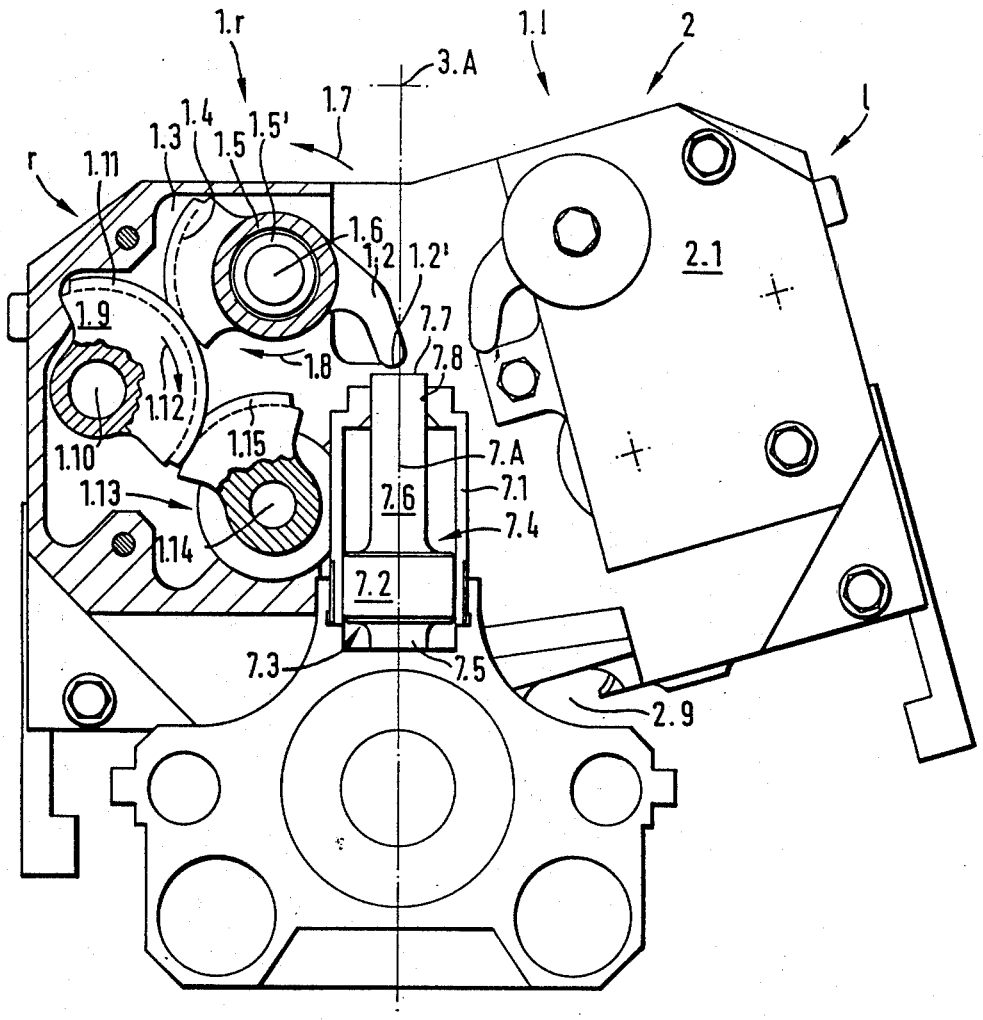
FIG. 2 is a transverse sectional elevational view along line II—II in FIG. 1.

The manner of operation of the alternate feeder in accordance with the invention occurs as follows:

While the arrangement is in the neutral intermediate position, as illustrated in FIG. 5, there is introduced into one of both belt inlets 2.15, for example the left belt inlet 2.15l the end of an ammunition belt (not illustrated). By actuating the auxiliary pinion 8.15l, by means of the previously described manual actuation of a tool, in the counterclockwise direction (arrow L) there is turned by means of the intermediate pinions 8.16 the cylindrical jacket 1.16 with both star wheels 1.24 and 1.25 in the counterclockwise direction. A first cartridge 9.1l arrives in a pocket 1.28 and 1.29 formed between corresponding adjacent teeeth 1.26 and 1.27 of the corresponding star wheel and finally arrives via the expelling slit 2.9l (FIG. 1) and in the immediate left-sided vicinity of both swing levers 8.23 and 8.24 (FIG. 2). Thereafter, there is operated the right feeder 1.r in the conventional feed operation. The alternate belt feeder is thereafter loaded on both sides.

In a breech position, in accordance with FIG. 1, the cartridge 9r.1 is disposed with a portion of its bottom 9.1 in the operative region of the side of the entrainer 6.1 which confronts the breech. The cartridge 9r.1 (see FIG. 4) has its longitudinal axis of cartridge and projectile 9.2 disposed at an angle with respect to the horizontal (see FIG. 1) while on its upper side the cartridge 9.4 is in contact with the underside of the spring biased hold-down member 2.20. The projectile point is disposed in the vicinity of not further illustrated deflecting surface forming part of the middle wall 2.5. During the forward propelling of the breech block 6 in the direction of the arrow 6.3 the cartridge 9.4 with projectile 9.2 arrives in a known manner into the loading chamber 4.2 and is ready to be fired. During firing, that is after ignition, a portion of the propelling gases are conducted via a non-illustrated conduit and a path not illustrated and described in detail, through the gas channel 5.2 into the inner chamber 7.12 of the gas cylinder 7.1 on the receiving side 7.3 of the piston 7.2. The latter is thereby axially upwardly moved and entrains with its upper end face 7.7 the energy input lever 1.2 against the action of the return spring force of the torsion spring 1.5[1]. The jacket 1.5 moves in the direction of arrow 1.7, via the form-locking engagement between the toothed segments 1.4 and 1.11, so that the latter moves into the direction of the arrow 1.12 and causes the jacket 1.16, via the meshing engagement with toothed segment 1.15, to entrain the star wheel 1.24 and 1.25 via the transport coupling sleeve 1.19. Thereby the holding coupling sleeve 1.20 slides through. By repositioning the torsion spring 1.5[1], which in a compulsory position also repositions the piston 7.2 into its starting position, the transport coupling sleeve 1.9 slides through. The cartridge 9r.2 moves via the expelling slit 2.9r. The holding coupling sleeve 1.20 grasps and prevents a rotation of the jacket 1.16 opposite to the afore-mentioned transport direction. The breech block 6 pulls the empty cartridge i.4 along its path 6.2 and in the direction of the arrow 6.4 by known means out of the loading chamber 4.2. It is then removed by means of the cartridge expeller 5.3.

For exchanging the ammunition from the left feeder 1.1 the feeder housing is, after detaching of a fixing mechanism, swung through the neutral into the other end position. The levers 8.23 and 8.24 which are form-lockingly fixed into the housing are also moved thereby. The expelling slit 2.9l with the cartridge 9l.1 immediately disposed above it, arrives in the region confronting the entrainer 6.1. The further operation corresponds to that described conjunction with the right feeder 1.r. As has been mentioned previously, there can not be positioned in the neutral intermediate position, as illustrated in FIG. 5, a cartridge in the operative region of entrainer 6.1. This position is therefore preferably suitable as a safety or secure position.

For unloading the left feeder 1.1 the following operation occurs: The feeder housing 2 is fixed in the neutral intermediate position (FIG. 5). By manually actuating a tool the central switching pinion 8.1 is rotated counterclockwise, so that the marking U on the outer periphery of the shaft stump 8.3'' of the switching roller 8.3 (in view of its rotation in the clockwise direction, is moved from its coinciding covering position with the center mark F ("FIRE") and the marking E1 on the rear, outer end face wall 8.20 is approached. Thereby the following occurs: By means of the rotary motion of the switching roller 8.3 in the clockwise direction the blocking segment 8.8 within the fixing recess 8.10 of the control support 8.9 and the coupling puller 8.71 releases the coupling-sided form locking connection within the support shaft structure 1.18l, in that the support member 1.23l is pulled rearwardly via the control recess 1.30l. During further rotation the blocking segment 8.8 leaves the fixing recess 8.10 and releases the control support member 8.9 for lateral movement, thereby the toothed circular segment 8.4 meshes with the toothed rack 8.11 in the region of the edge 8.5r, so that further rotation moves the control support member 8.9 to the left. Due to the form locking connection (pivot bolt 8.24[1] on the swing lever 8.24 and with it the corresponding recess 8.12 in the control support member 8.9), the spring levers 8.23 and 8.24 are swung toward the left against the star wheel support arrangement 1.13l. Thereby a cartridge positioned above the expelling slit 2.9l is pushed back into the next following pocket 1.28 and 1.29 of the corresponding star wheel, from which it had come out via the expelling slit 2.9l, and the jacket 1.16l, therefore moves in the clockwise direction. As soon as the shaft stub marking U coincides and covers the marking E1, there can, by means of the corresponding manual operation by rotating the auxiliary pinion 8.15l the jacket 1.16 is further rotated in the clockwise direction, so that all cartridges can be removed. Thereby there is assured, that the cartridges can again be belted. The necessary steps for effecting this are not further described in detail. After removal of the belts from the belt inlet 2.15l the aforedescribed operation for rotating the central switching pinion 8.1 in the opposite direction can be carried out correspondingly for the feeder 1.r, in order to unload the same.

When the shaft stub marking U coincides or covers the marking F ("FIRE"), the corresponding arrangement is fixed by the control and switching means 8.h with safety in its operative position. In the latter case each of both feeders can be loaded, whereas the unloading requires the aforedescribed preparations.

In order to make it possible for the respective star wheel shaft arrangement 1.13 to be separated in advance from the mounting unit 8.M, the edge region 8.3[1] has two non-illustrated recesses, which coact with the control recesses 1.30 in such a way that they do not present an obstacle to a respective control stop 1.31 during the pulling out of the corresponding star wheel shaft arrangement 1.13. As can be noted from the aforedescribed operation the switching roller 8.3 has a plurality of functions while being constructed in an extraordinarily space saving arrangement for the controlling and switching means 8.h and which requires only a very small number of individual parts which can be combined with the auxiliary arrangements 8.s (l,r) for easy manual operation of the mounting unit 8.M.

A machine cannon having an alternate feeder in accordance with the invention can advantageously also be used under extremely adverse condition and in an unfavorable terrain, since the respective torsion spring 1.5[1] securely repositions the gas piston 7.2.

Although the invention is illustrated and described with reference to a plurality of preferred embodiments thereof, it is to be expressly understood that it is in no way limited to the disclosure of such preferred embodiments, but is capable of numerous modifications within the scope of the appended claims.

I claim:

1. An improved alternate ammunition belt feeder for an automatic fire arm having a linear breech, in particular a machine cannon, for selectively feeding ammunition from two separate ammunition belts arranged above the belt feeder via respectively a first and second cartridge feeding means, said first and second feeding means including two rotatable mirror-symmetrically arranged cartridge feeding stars mounted on respective support shafts therefor and a gas-pressure actuated energy converter including a piston-cylinder arrangement which is adapted to selectively provide driving energy received from the propellant gas which forms during firing to one of the two cartridge feeding stars and further having a housing which is laterally movable relative to the longitudinal axis of the weapon between a first and second end position through an intermediate position so that when said housing is selectively switched into one of the two end positions a ready to be fired cartridge from the first or second guide means is directly positioned into a position for entrainment by the breech of the weapon by the coaction of an energy receiving means which is operatively connected to the energy converter which is adapted to coact with said first (second) feeding means, the improvement comprising, (a) said support shafts of the cartridge feeding stars are operatively mounted in said housing which is pivotally mounted in said belt feeder about an axis which is spaced from and parallel to the longitudinal axis of the weapon, so that said housing can be swung from one end position to the other end position via said intermediate position;

(b) said energy receiving means having a first actuating member which is adapted to coact with the piston of said piston-cylinder arrangement;

(c) said energy receiving means having a second actuating member which is operatively connected via form-locking driving means with the respective support shafts of the cartridge feeding stars;

(d) switching and control means are adapted to be operatively connected to the respective support shaft of the cartridge feeding star to introduce the required rotary and axial movement thereto for loading and unloading;

(e) the housing has a cartridge expelling slit for each cartridge feeding means;

(f) the cartridge expelling slits are separated from each other by a bisecting foot portion;

(g) when said housing is in the intermediate position there is no form-locking engagement between the piston and the energy receiving means, said foot portion having a U-profile so that the breech of the weapon can reciprocate along its operative path without engaging any parts of said ammunition belt feeder; and (h) said housing having a belt inlet opening adjacent to and to the left or right of said swing axis;

2. The improvement in an alternate ammunition belt feeder for an automatic fire arm as set forth in claim 1, wherein (a) each energy receiving means includes a torsion spring which operates as a repositioning spring;

(b) each support shaft encompasses a transport coupling (1.19') and a holding coupling (1.20') for receiving the ammunition belt pull; and (c) each of both couplings of both support shafts is adapted to be uncoupled by that part of said switching and control means which respectively coacts therewith.

3. The improvement in an alternate ammunition belt feeder for an automatic fire arm, as set forth in claim 2, wherein (a) for each support shaft of the cartridge feeding star is there exclusively connected thereto driving means and a first auxiliary arrangement;

(b) the control and switching means and a second auxiliary arrangement is adapted to coact with both support shafts.

4. The improvement in an alternate ammunition belt feeder for an automatic fire arm, as set forth in claim 3, wherein (a) said energy receiving means is formed as a deflectable, two-armed lever rotatably mounted about an axis whereby one arm of said two-armed lever is formed as a toothed segment, disposed in spaced relationship to said piston and is in meshing form-locking engagement with said driving means;

(b) said driving means include respectively an intermediate gear wheel having an arcuate toothed peripheral segment and an arcuate toothed segment of the respective support shaft said arcuate toothed segments being adapted to mesh with each other;

(c) the toothed segment meshes with the toothed segment of the intermediate gear wheel, which in turn meshes via the toothed segment with the toothed segment of the support shaft;

(d) whereby the respective directions of rotation of the support shafts are mutually opposite with respect to each other.

5. The improvement in an alternate ammunition belt feeder for an automatic fire arm, as set forth in claim 4, wherein (a) said form-locking meshing driving means are arranged in confronting relationship to the front end of the corresponding support shaft;

(b) said switching and control means and said first auxiliary arrangement are arranged in confronting relationship with the respective rear end of the corresponding support shaft; and (c) the switching and control means, the first and second auxiliary arrangements and the support shafts form with a rear wall arrangement a further disassemblable unit.

6. The improvement in an alternate ammunition belt feeder for an automatic fire arm, as set forth in claim 5, wherein said unit is detachably mounted by means of two pins in the housing and after removal of the two pins the unit can be pulled out of the housing.

7. The improvement in an alternate ammunition belt feeder for an automatic fire arm, as set forth in claim 6, wherein a hold-down member is operatively mounted in each cartridge means and is adapted to bias a thereto fed cartridge towards the respective expelling slit in the corresponding cartridge feeding means.

8. The improvement in an alternate ammunition belt feeder for an automatic fire arm, as set forth in claim 7, wherein (a) said switching and control means which is adapted to actuate the second auxiliary arrangement is operatively mounted between both feeding means, said second auxiliary arrangement includes two levers;

(b) said second auxiliary arrangement coacts with both cartridge feeding means; and (c) by actuating said second auxiliary arrangement it moves a cartridge disposed over a corresponding expelling slit in a first free transport pocket of the cartridge feeding star, which is rotated by virtue of a meshing engagement with the second auxiliary arrangement over a predetermined angle opposite to the feed direction.

9. The improvement in an alternate ammunition belt feeder for an automatic fire arm, as set forth in claim 8, wherein said second auxiliary arrangement is detachably connected to the rear wall and is adapted to be pulled out of the housing as a unit together with the unit.

* * * * *